US007028960B2

(12) United States Patent
Goldstein

(10) Patent No.: US 7,028,960 B2
(45) Date of Patent: Apr. 18, 2006

(54) CURTAIN RODS AND SUPPORTS THEREFOR

(75) Inventor: Allan Goldstein, Old Tappan, NJ (US)

(73) Assignee: Source Global Enterprises, Inc., Bronx, NY (US)

( * ) Notice: Subject to any disclaimer, the term of this patent is extended or adjusted under 35 U.S.C. 154(b) by 277 days.

(21) Appl. No.: 10/247,108

(22) Filed: Sep. 19, 2002

(65) Prior Publication Data

US 2003/0052244 A1 Mar. 20, 2003

Related U.S. Application Data

(60) Provisional application No. 60/324,119, filed on Sep. 20, 2001.

(51) Int. Cl.
*A47H 1/10* (2006.01)

(52) U.S. Cl. ..... 248/263; 248/262

(58) Field of Classification Search ..... 248/255, 248/256, 259, 263–265; 160/38, 39, 126; 211/105.1, 105.3, 105.2; 16/94 R, 96 R, 16/87 R, 95 D, 95 R
See application file for complete search history.

(56) References Cited

U.S. PATENT DOCUMENTS

| | | | | |
|---|---|---|---|---|
| 752,425 | A * | 2/1904 | Spangler | |
| 1,561,990 | A * | 11/1925 | Maciejko | |
| 2,405,020 | A * | 7/1946 | Dierking | |
| 2,433,527 | A * | 12/1947 | Mohr | |
| 3,218,017 | A * | 11/1965 | Butler | |
| 5,330,821 | A * | 7/1994 | Lo | 428/120 |
| 6,467,127 | B1 * | 10/2002 | Goldstein | 16/87 R |

* cited by examiner

*Primary Examiner*—Ramon O Ramirez
(74) *Attorney, Agent, or Firm*—Levin & Mandelbaum

(57) ABSTRACT

A curtain rod has a C-shaped cross section for receiving tongues on main wall mountable main brackets. Slotted supplementary brackets are mountable over the main brackets for permitting one or more supplementary curtain rods to be hung without drilling holes in the wall additional to those provided for the main brackets. Intermediate main and supplemental brackets support long curtain rods between their ends to prevent sagging. The supplemental curtain rod brackets are adapted for hanging the supplemental curtain rods at heights varying from that of the main curtain and the main and supplemental curtain rod brackets are further adapted for independently varying the distance of each set of curtains from the wall. Decorative hangers have rollers for movements along the main curtain rod have bumpers to prevent overlapping of the wheels and resultant binding.

10 Claims, 15 Drawing Sheets

CURTAIN RODS AND SUPPORTS THEREFOR

BACKGROUND OF THE INVENTION

The present invention is directed to a novel curtain rod structure which is both aesthetically decorative, able to support multiple sets of curtains, and resistant to binding when operated to traverse the curtains. More specifically, the present invention provides for a main curtain rod which is visible when curtains are suspended from hangers movably mounted on the rod, and one or more supplemental curtain rods, each of which can support a set of curtains. Only one set of brackets need be affixed to the wall or ceiling no matter how many sets of curtains are to be hung. The present invention provides for changing the height of each set of curtains relative to the others to compensate for dimensional differences among the curtains to be hung on the respective rods.

It is known in the art to hang curtains from a wall or ceiling by suspending the curtains on a rod which is connected to a respective bracket at each of its ends, the brackets being attached to a mounting surface, i.e., on a wall or ceiling, by screws threaded into holes drilled in the mounting surface. It is also known to hang two or more sets of curtains, each set on a separate rod, with each separate rod being mounted on a respective pair of brackets screwed into the mounting surface of the wall or ceiling.

It is further known to hang curtains on a traverse rod wherein the curtains are suspended from hangers which are moveable along a track in the rod for enabling the curtains to be opened and closed by a draw string. In order to hide the traverse rod and hangers, which are generally unsightly, a fabric valence is often hung on a rod passed through a channel formed by parallel stitching of two layers of fabric in the valence, or a self supporting valence is directly mounted on the wall surface with screws making further holes.

Prior art rods and brackets for hanging multiple sets of curtains require a separate set of brackets for each rod, which must be affixed to a mounting surface by making separate holes for each bracket. Once the prior art brackets are attached to a mounting surface, the relative elevations of the rods they support cannot be altered, as may be required when replacement curtains have dimensions which vary from the original curtains, without making new holes in the mounting surface for changing the position of the brackets.

When multiple prior art rods are used, each must be of a different length, with the outermost being the longest, and the innermost being the shortest, in order for its brackets to have access to the mounting surface.

The hangers on prior art traverse rods are subject to jamming when the wheels on which they ride overlap and become wedged in the track of the rod.

SUMMARY OF THE INVENTION

The present invention overcomes the aforestated problems of the prior art by providing a traverse rod having a decorative visible front surface and hangers with decorative elements movable along the front of the rod and other decorative elements stationary on the side brackets of the rod for hanging a front traversing set of curtains with ends, in wrapped around disposition, fixed to the end brackets of the rods. The brackets which support the main set of curtains are adapted to receive secondary brackets which support one or more supplemental sets of curtains mounted rearwardly of the main set of curtains. The main brackets and supplemental brackets can be mounted at varying relative heights in order to compensate for dimensional differences among the various sets of curtains, and to allow replacement curtains, whose dimensions vary from those of the original curtains for which they are substituted, to be hung at the proper height.

DESCRIPTION OF THE PREFERRED EMBODIMENT

Figure 1A:
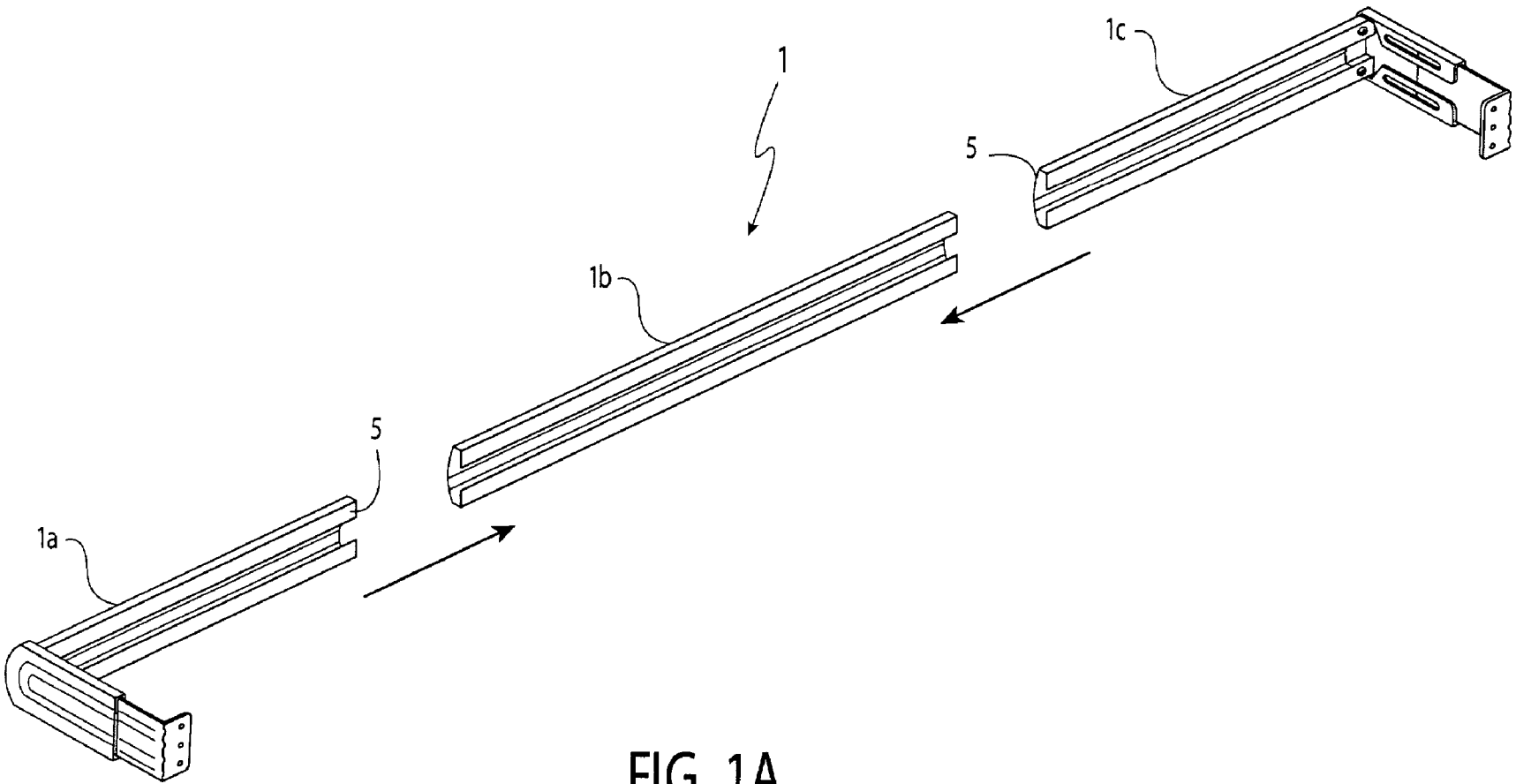
FIG. 1A is an exploded perspective view of a main curtain rod in accordance with the preferred embodiment of the invention.
Figure 1B:
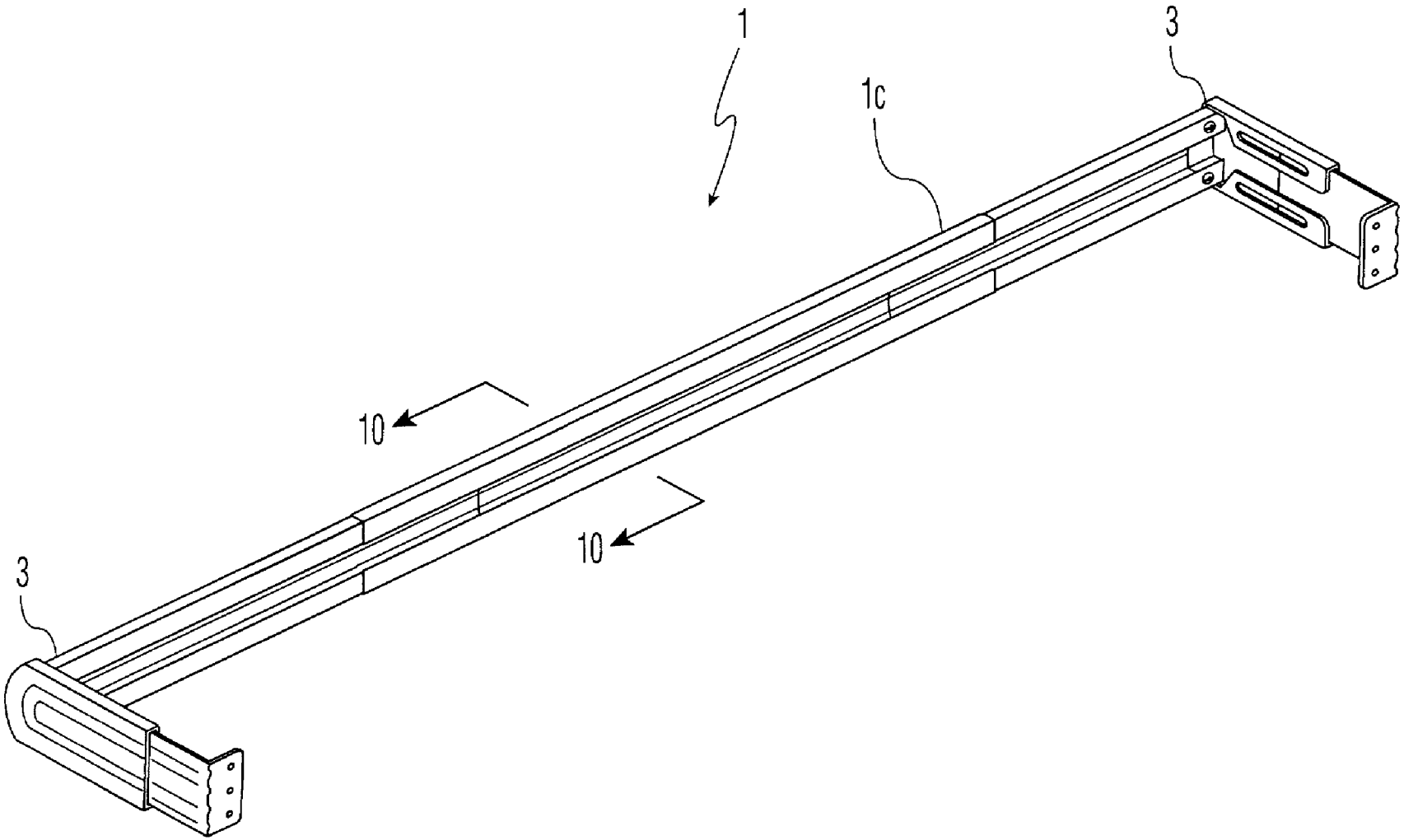
FIG. 1B is a perspective view of an assembled main curtain rod in accordance with the preferred embodiment of the invention.
Figure 2:
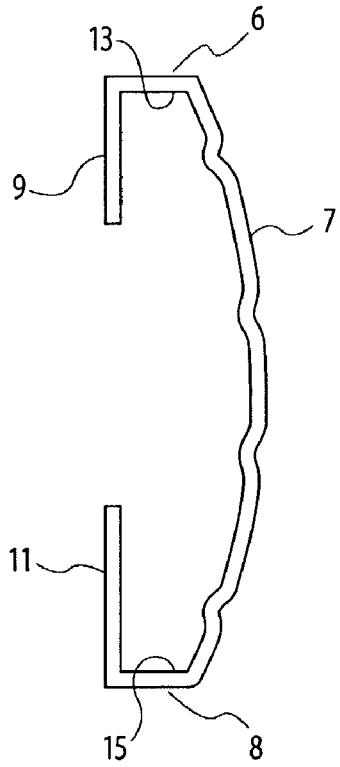
FIG. 2 is a side elevation view of a segment of the main curtain rod of FIG. 1.

Referring now to FIGS. 1A and 1B, there is shown a main curtain rod 1, having three telescoping elongated segments 1*a*, 1*b*, and 1*c*. Each of two outermost segments, 1*a* and 1*c*, has a free end 3 and an end 5 inserted within the third central segment 1*b*. As seen in FIG. 2, each segment is preferably formed from sheet metal and bent into a generally C-shaped configuration with parallel top and bottom edges 6 and 8, respectively, running the length of each main rod segment, a convex face 7 extending between the edges 6, 8, which can be viewed when the main rod is hung, and top and bottom spaced lips 9, 11 extending toward one another from the edges 6,8, behind the face 7. An upper channel 13 is formed opposite upper edge 6, between the upper lip 9 and the face 7 of each segment, and a lower channel 15 is formed opposite lower edge 8, between the lower lip 11 and the face 7 of each segment. The cross sectional profile of the central segment 1*b* is geometrically similar to, and slightly larger than the geometrically congruent cross sectional profiles of the outermost segments 1*a*, 1*c* whereby the outermost segments 1*a*, 1*c* can be telescoped within the central segment 1*b*.

The visible face 7 of each segment can be grooved for a decorative effect and is also preferably covered with a decorative finish, e.g., bronze, pewter, antique or any other aesthetically appropriate finish.

Figure 3:
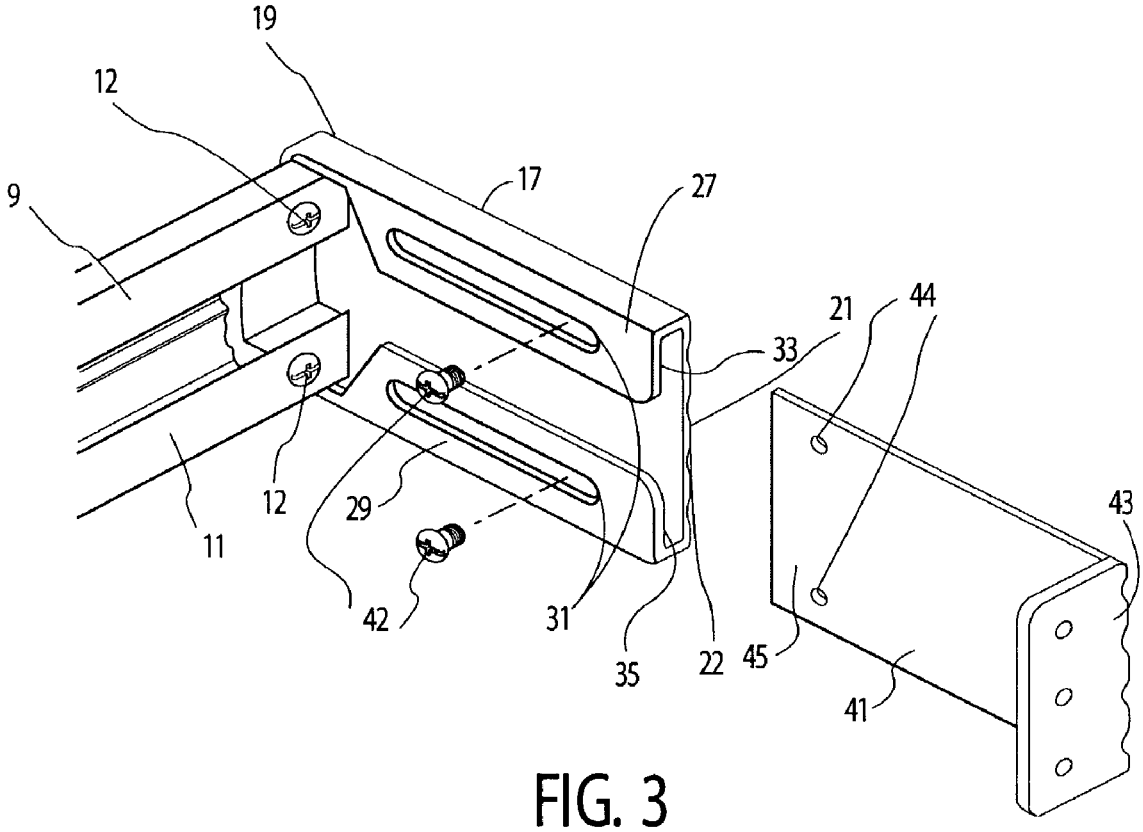
FIG. 3 is a perspective view showing assembly of the main curtain rod to a bracket for hanging on a wall.
Figure 4:
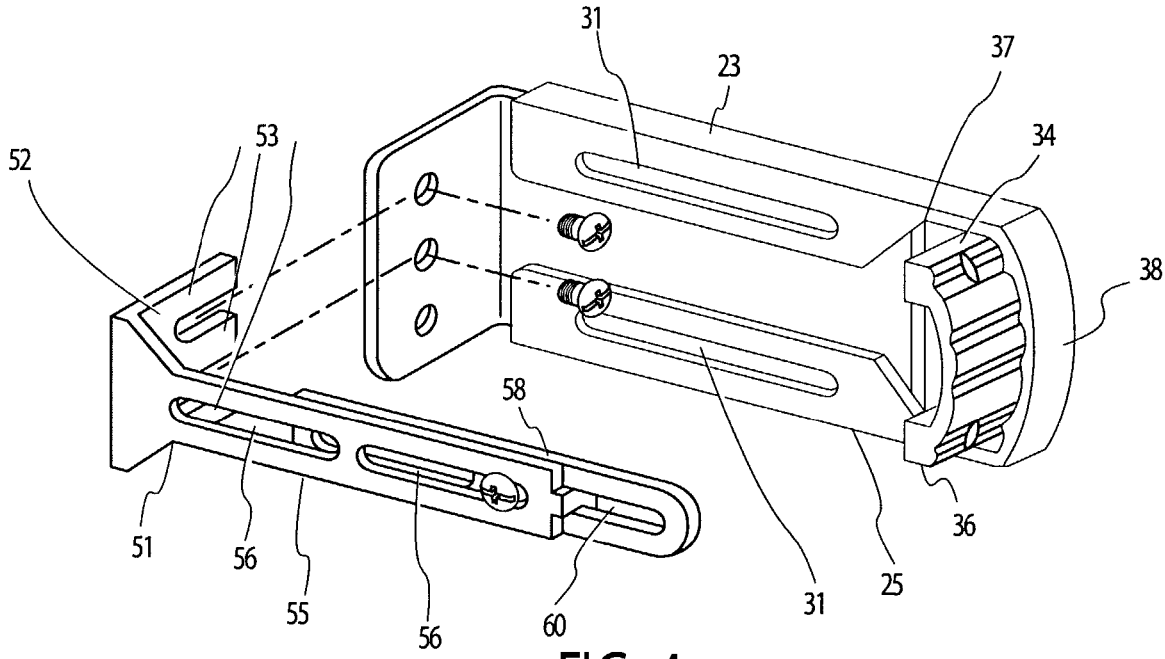
FIG. 4 is a perspective view showing assembly of a supplemental bracket for hanging a supplemental curtain rod on a wall.

Referring now to FIGS. 3 and 4, each lip 9, 11 of each outermost segment has an aperture adjacent its free end for receiving a screw 12 which is threaded into a corresponding aperture on a corner bracket 19 of an end bracket assembly 17.

Each corner bracket 19 is of generally rectangular configuration, and has a length transverse to the length of the main rod, and a squared off C-shaped profile with a plate 20 having an outer face 21 (FIG. 14), a top ledge 23, a bottom ledge 25 and inward extending upper and lower lips 27 and 29, respectively, in parallel spaced relationship to the plate 20, running from a rear end 22 of the corner bracket 19, a distance less than the length of the plate 20. At least the outer face 21 of the plate 20 is preferably grooved and/or finished to match the grooves and/or finish on the visible face of each main rod segment 1*a*, 1*b*, 1*c*.

Each lip 27, 29, has a slot 31 parallel to the length of the corner bracket for enabling adjustment of the distance between the main rod 1 and the wall surface on which the main rod 1 is to be mounted as will hereinafter become apparent. An upper channel 33 is formed between the upper lip 27 and the outer face of each corner bracket, and a lower channel 35 is formed between the lower lip 29 and the outer face of each corner bracket.

Figure 5A:
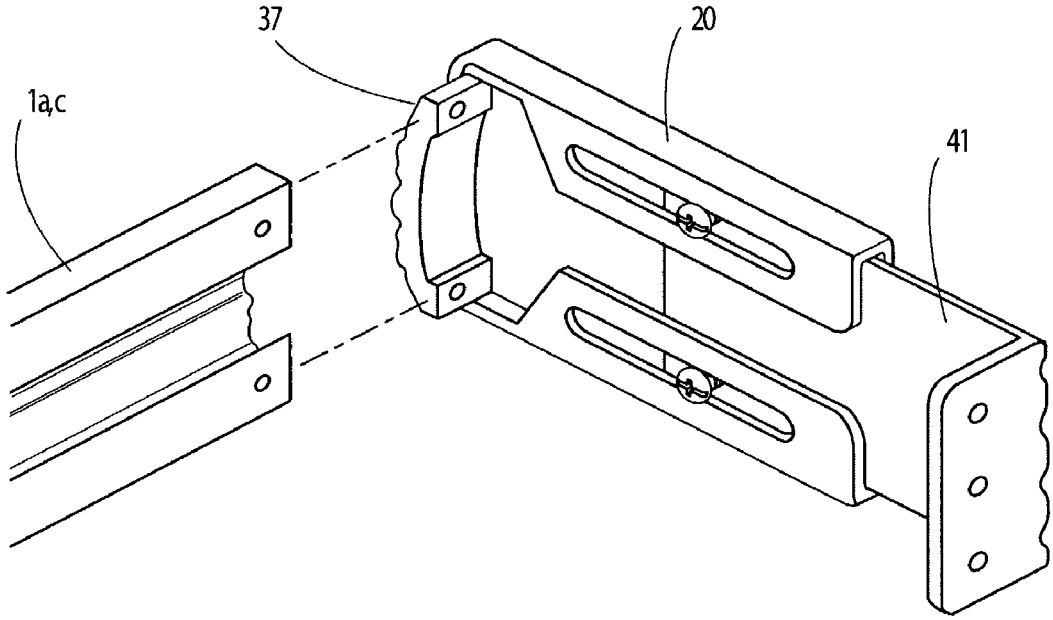
FIG. 5A is a rear perspective view showing the relationship between connecting members of a main curtain rod and a main curtain rod bracket.
Figure 5B:
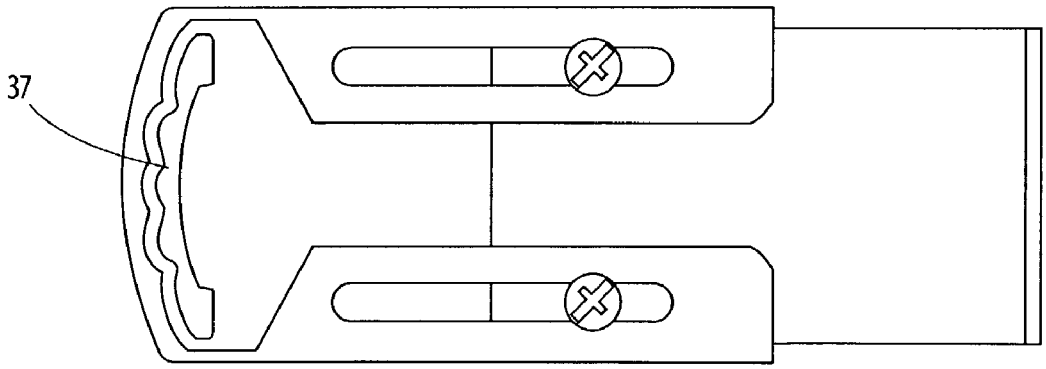
FIG. 5B is a rear elevation view showing the relationship between connecting members of a main curtain rod and a main curtain rod bracket.

Referring additionally FIGS. 5A and 5B, extending transversely from the rear surface of the plate 20 of the corner bracket is a tongue 37 having a curved and grooved profile complementary to the rear surface of the face of each outermost main rod segment 1*a*, 1*c*, and a height which enables the upper and lower edges 34, 36 of the tongue 37 to be snugly captured within the respective upper and lower channels 13, 15 of an outermost main rod segment 1*a*, 1*c*. A screw 12 is passed through each aperture in the segment lip 9, 11 and threaded into an aligned aperture in the tongue 37 of the respective corner bracket 19 for securing the corner bracket 19 to an end of a main rod segment 1*a*, 1*c*. A visible front edge 38 of the corner bracket, which resides forward of the tongue, is preferably curved to conform to the convex face of the adjacent outermost main rod segment.

In addition to the corner bracket 19, the bracket assembly 17 includes a rectangular wall mounting bracket 41 having transverse rectangular segments 43 and 45. The shorter segment 43 of the two segments 43, 45 is a rear segment having three aligned and equally spaced apertures for receiving screws to mount the rear segment on the surface of a wall. The larger segment 45 of the two segments 43, 45 serves as a rectangular tongue which can be slidably received within the upper and lower channels 33, 35 of the corner bracket 19 as seen in FIGS. 5A and 5B. Each corner bracket 19 and corresponding wall mounting bracket 41 can be telescoped to determine the distance of the main rod from the wall. The telescoping bracket assembly 17, which includes corner bracket 19 and wall mounting bracket 41, can be fixed in place by tightening two screws 42 passed through the upper and lower slots 31 in the lips of the corner bracket 19 and received in respective threaded apertures 44 in segment 45 of the wall mounting bracket 41.

Referring to FIG. 4, an end supplemental rod bracket 51 has a wall bracket mounting flange 52 with three fingers 53 defining, therebetween, two open-ended slots for enabling the flange 52 to be mounted in overlapping relationship with the rear segment 43 of the wall mounting bracket 41. The slots in the flange 52 of the end supplemental rod bracket 51 are of sufficient width and spacing to enable two of the three screws which secure the rear segment 43 of the wall mounting bracket 41 to the wall to be received within the slots with the heads of the screws engaging the fingers 53 for securing the end supplemental rod bracket 51 to the wall mounting bracket 41 without need for drilling additional holes in the wall.

Figure 6A:
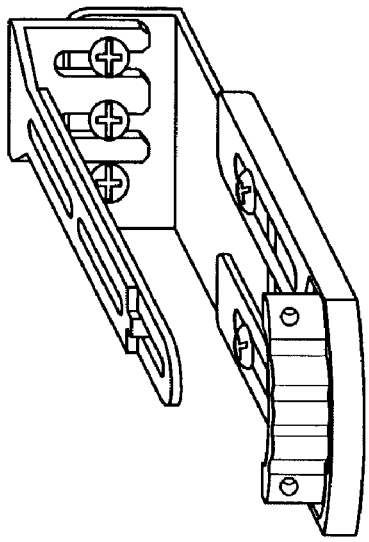
FIGS. 6A–C are perspective views illustrating three respective positions of the supplemental bracket of FIG. 4.
Figure 6B:
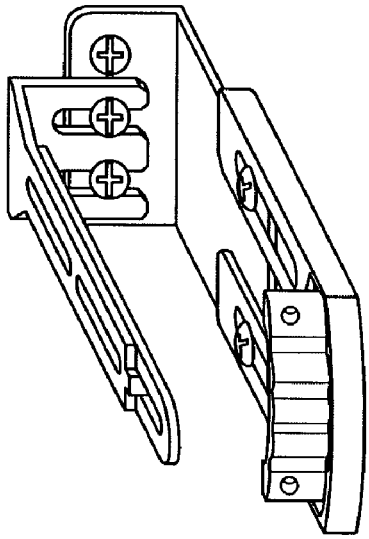
Figure 6C:
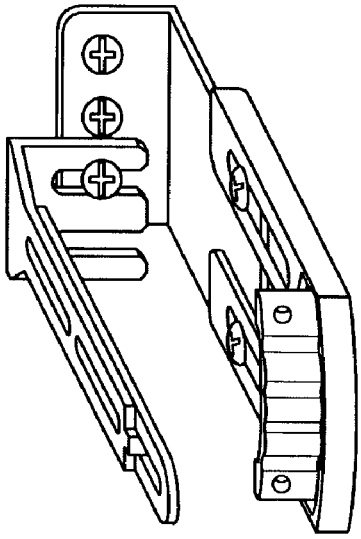

As can be seen in FIGS. 6A, 6B and 6C, the end supplemental rod bracket 51 may be mounted relative to the bracket assembly at different heights for adjusting the relative heights of two sets of curtains to compensate for dimensional differences among the curtains to be hung on main and supplemental rods, respectively. The height of the supplemental curtain rods relative to the main curtain rod can be varied by mounting the flange of the supplemental curtain rod bracket with its two open slots on the top and center screws of the wall mounting bracket (FIG. 6A) or the bottom and center screws of the wall mounting bracket (FIG. 6B). For greater height variations, the top slot of the supplemental curtain rod bracket flange can receive the bottom one of the three screws of the wall mounting bracket (FIG. 6C), or the bottom slot of the supplemental curtain rod bracket flange can receive the top one of the three screws of the wall mounting bracket (not shown). Thus the supplemental curtain rod brackets allow for hanging of a plurality of supplemental sets of curtains on rods which can be adjusted horizontally and vertically, without need for drilling any holes in the wall additional to the holes used to mount the main rod. This is a particularly beneficial feature when curtains are replaced on an existing rod installation.

Referring back to FIG. 4, transverse to and extending forwardly from the flange 52 of the end supplemental rod bracket 51 is an elongated, substantially rectangular finger 55 having central axial slots 56. For strength, the finger is bridged between adjacent slots. A single slot running substantially the whole length of the finger 55 may suffice in applications where reinforcement by bridging is not required.

Slidably mounted on the finger 55 is an extension plate or finger 58 having aligned central axial slots 60 in axial registration with the slots 56. The plate 58 may be translated relative to the finger 55 and held in place by one or more screws passed through the overlapping slots 56 and 60.

Figure 7:
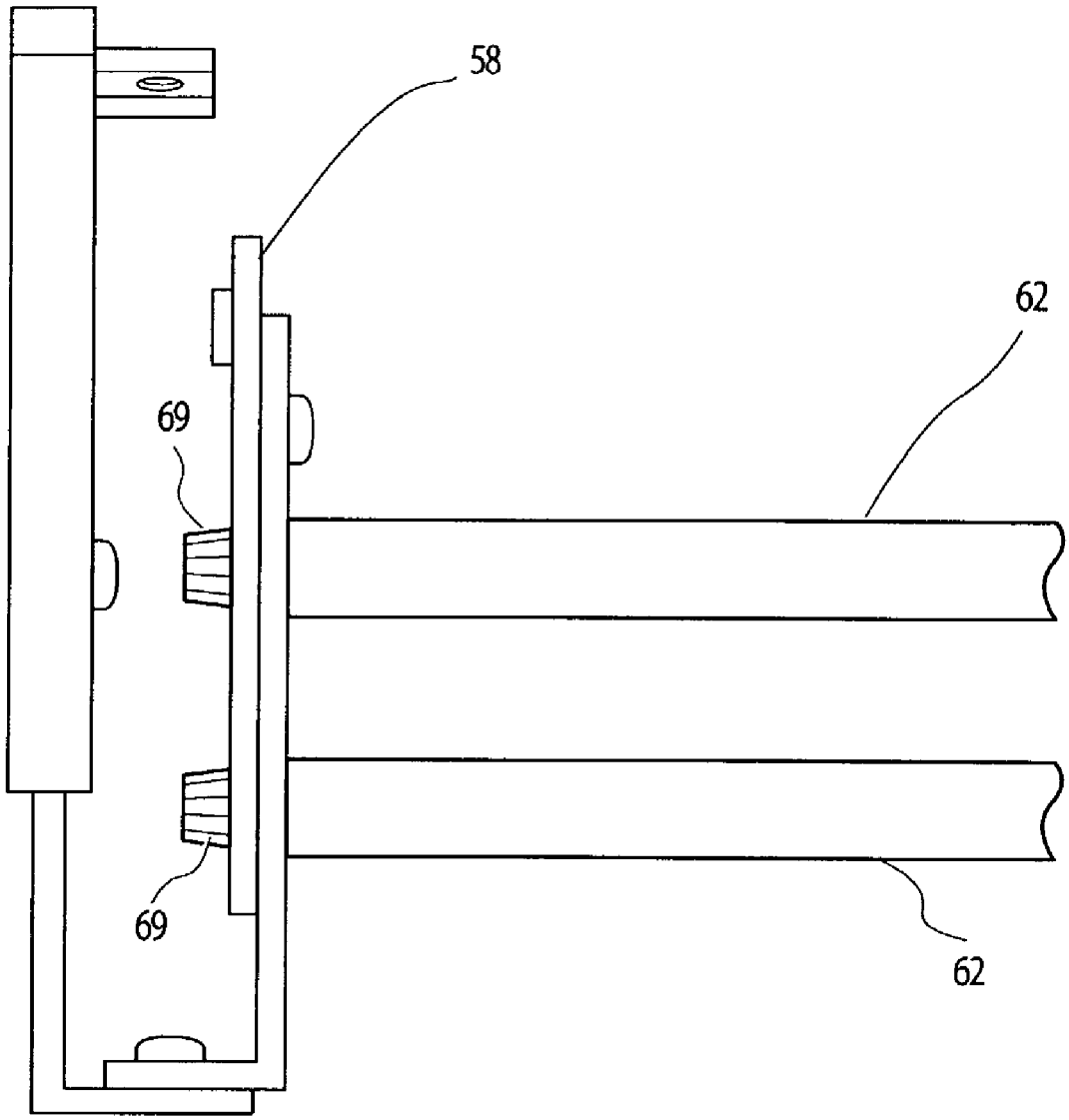
FIG. 7 is a fragmentary plan view showing two supplemental curtain rods mounted on the supplementary bracket of FIG. 4.

As shown in FIG. 7, an end cap having a projecting screw (not shown) can be mounted at either end of a one or more supplemental cylindrical rods 62. The screws can be passed through the slots 56, 60 in the cylindrical rod holder's finger 55 and, optionally, an extension plate 58, and cap nuts 69 can then be applied to the projecting screws to secure the ends of the supplemental cylindrical rods in place. The distance of each supplemental set of curtains from the main curtains can be varied, independently, by moving each supplemental rod relative to the finger 55, and by moving the corner bracket 19 relative to the wall mounting bracket 41.

Figure 8:
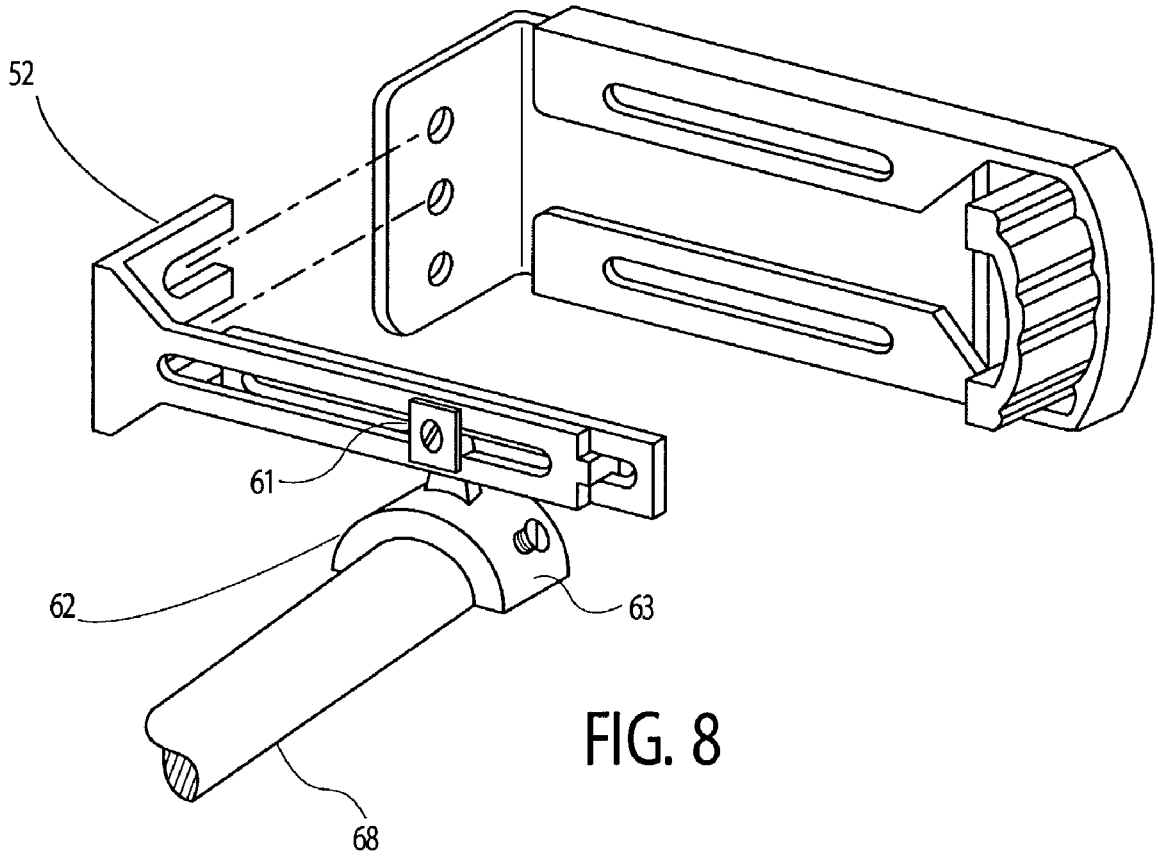
FIGS. 8 and 9 are perspective views showing a holder for supporting a cylindrical curtain rod on the supplementary bracket of FIG. 4.
Figure 9:
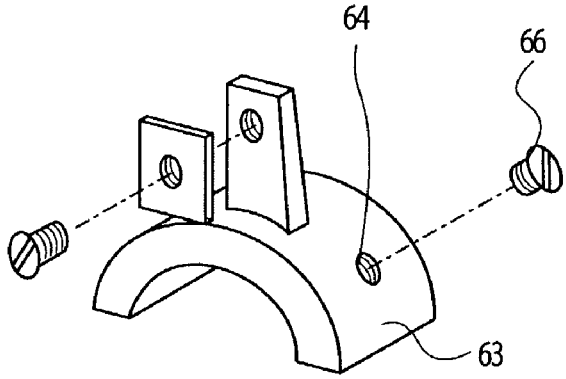

Referring to FIGS. 8 and 9, a cylindrical rod holder 62 has a tab 61 with a threaded aperture adapted to receive a screw passed through the finger central slot 56 and, optionally, the extension plate slot 60, for locking the holder 62 in place at any desired position along the length of the supplemental mounting bracket 51. Mounted beneath the tab is a downward facing truncated circular holder 63 having an aperture 64 into which a set screw 66 is threaded. A cylindrical curtain rod 68 can be inserted into the holder 63 and held in place by tightening the set screw 66 against the circumference of the cylindrical curtain rod.

The supplementary curtain rod 68 can be used to hang an additional set of curtains rearwardly of the curtains hanging from the main rod 1. Conventional hangers adapted for use with cylindrical rods may be used as will be known to those skilled in the art. One, two or more supplemental sets of curtains may be hung, one behind the other, by mounting a corresponding number of cylindrical curtain rods on a pair of end supplemental rod brackets 51 which are, in turn, mounted on wall mounting brackets 41 at respective ends of the main curtain rod 1.

Figure 10:
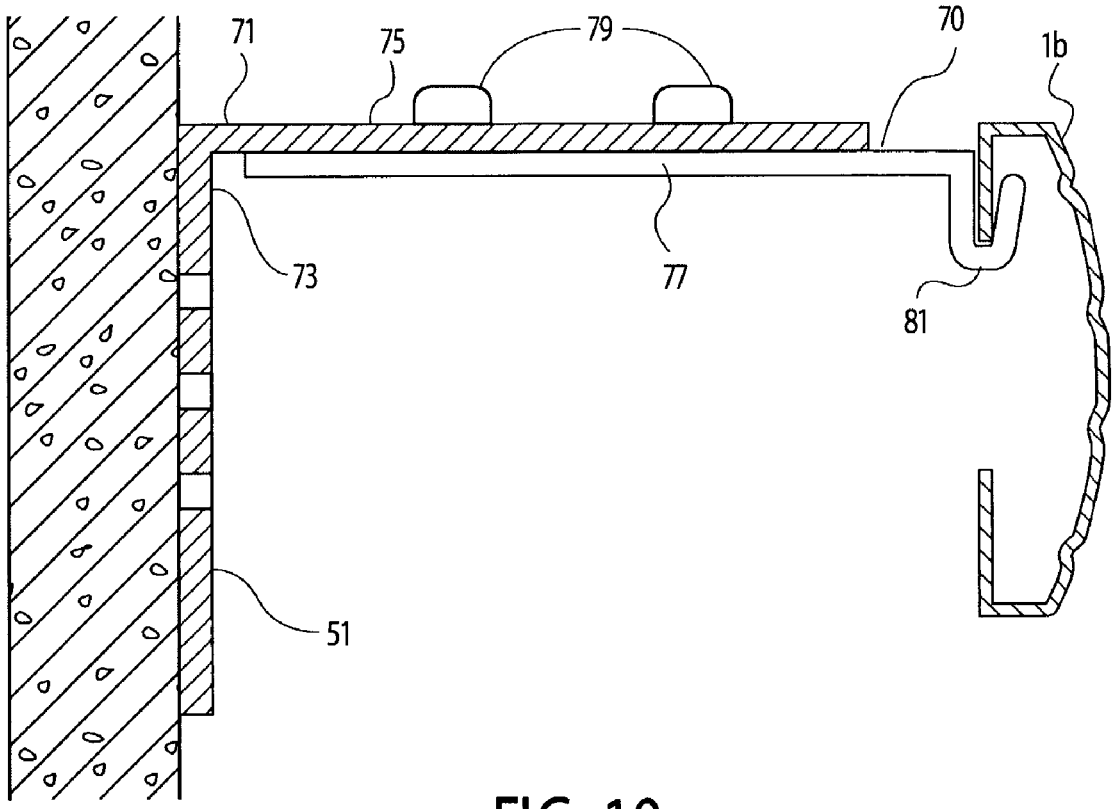
FIG. 10 is a side elevation view of an assembly of an intermediate curtain rod bracket supporting the main rod intermediate its ends in accordance with the preferred embodiment of the invention.
Figure 11:
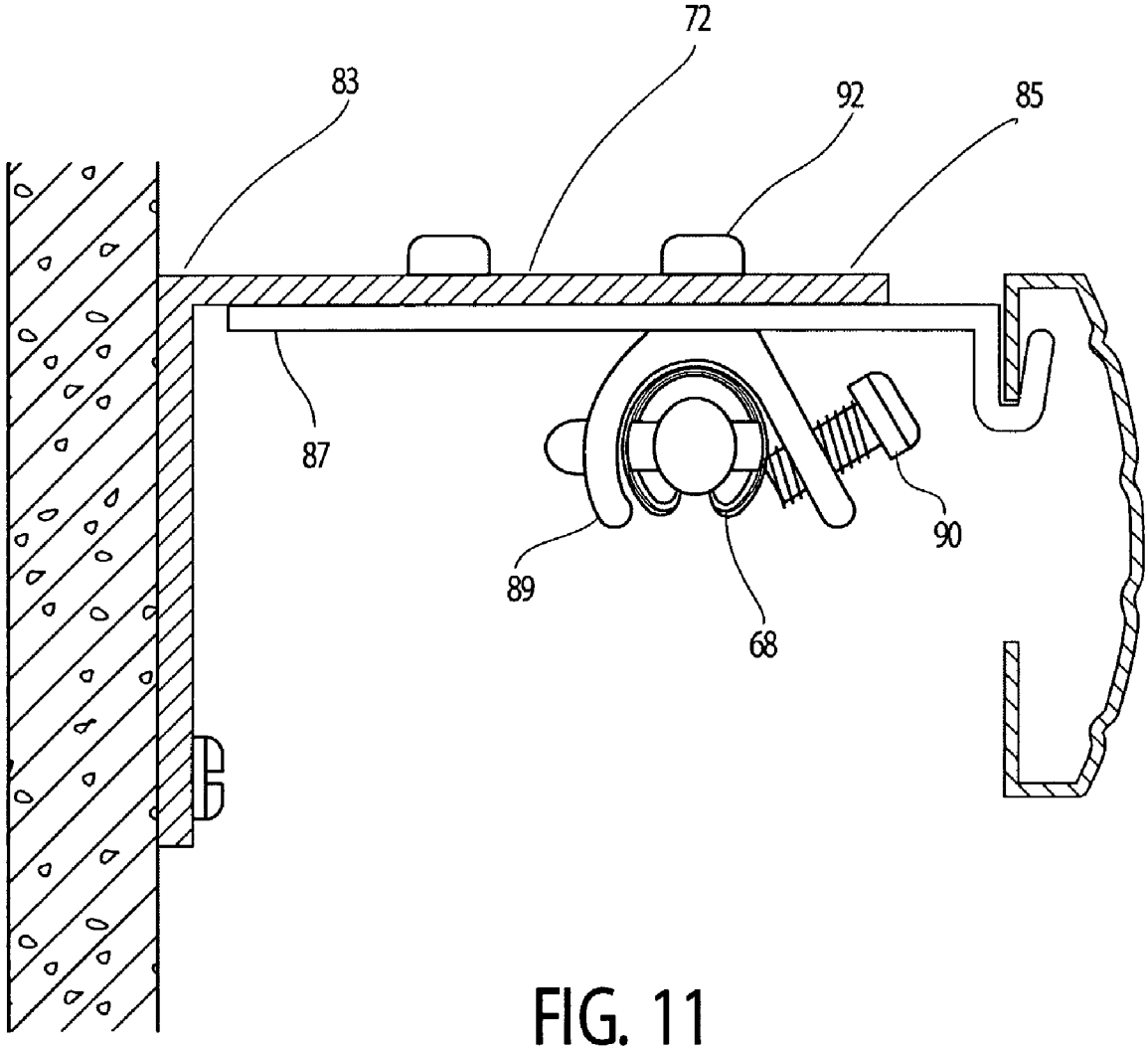
FIGS. 11 and 12 are side elevation views showing an assembly of a main rod and supplemental curtain rod with a bracket for supporting the rods intermediate their ends in accordance with the preferred embodiment of the invention.
Figure 12:
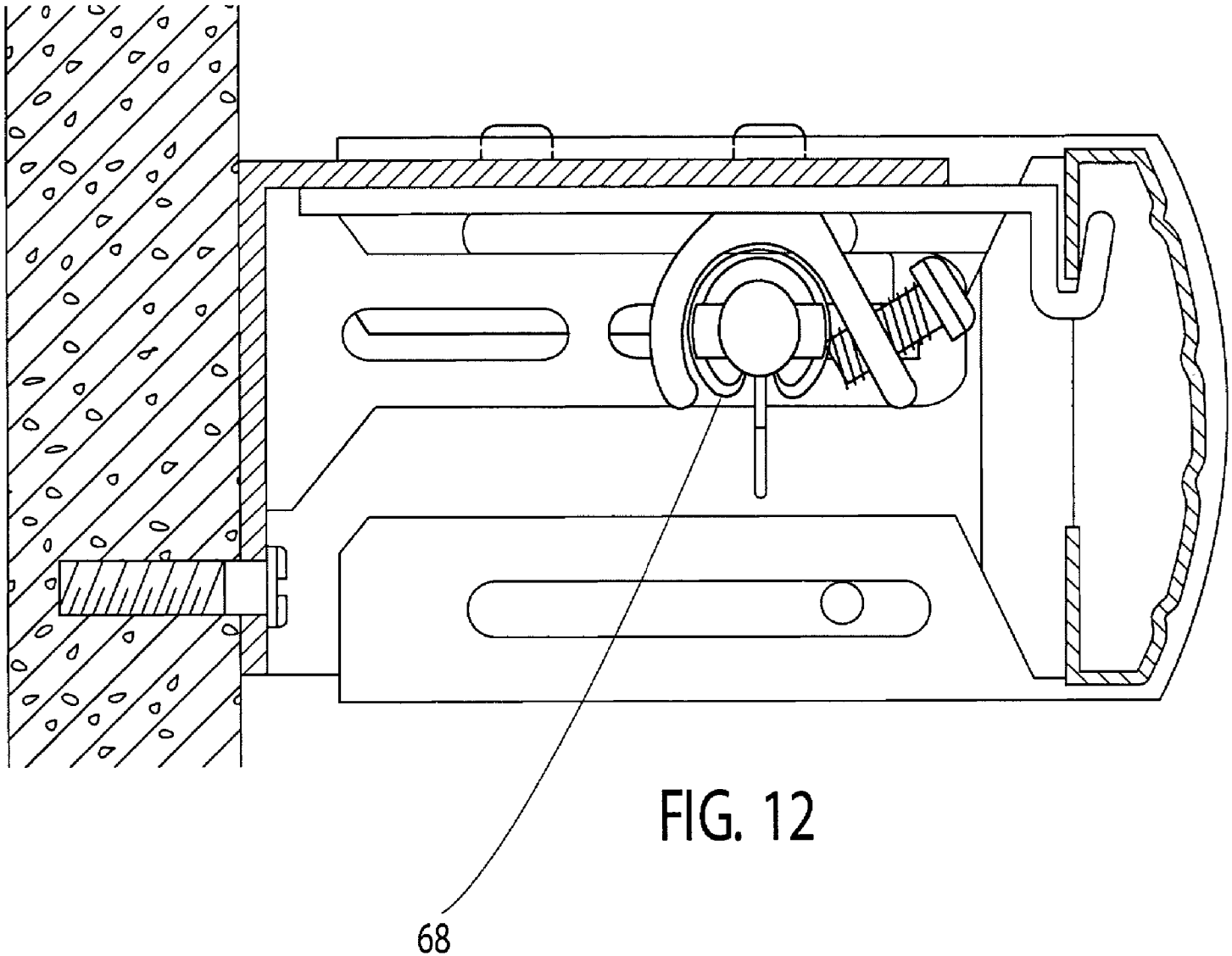

Referring to FIGS. 10–12, in addition to the main rod bracket assemblies described above, the invention provides for one or more identical intermediate main rod bracket assemblies 70 and a corresponding number of intermediate supplemental rod bracket assemblies 72 for use with very long rods which may otherwise be subject to sagging.

Figure 10A:
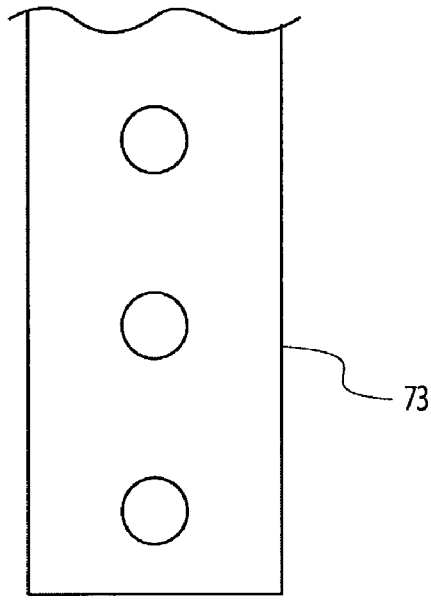
FIG. 10A is a partial front elevation view a portion of the bracket of FIG. 10.

Referring to FIG. 10, an intermediate main rod bracket assembly 70 has a right angle wall bracket 71 with a wall mountable flange 73 (FIG. 10A) having three axial apertures for receiving screws threaded into the wall and a transverse outward projecting member 75 having a central axial slot. A substantially rectangular main rod support member 77 can have a central axial slot, or one or more threaded apertures for receiving one or more corresponding set screws 79. The rectangular main rod support member 77 also has an outermost end 81 with a U-shaped cross section so that the end of the main rod support member 77 can be received in the upper channel 13 of a main rod segment 1*b* for supporting the main rod intermediate its ends without interfering with the traversing hangers described below.

The intermediate main rod bracket assembly 70 can be adjusted to accommodate the distance of the main rod from the wall by loosening the set screws 79 to move the main rod support member 77 inwardly and outwardly relative to the wall mountable flange 73, and thereafter tightening the set screws 79 to hold the main rod support member 77 in place. Where slots are used in both the main rod support member 77 and wall mountable flange, fasteners can be provided to lock the set screws in place. Where threaded apertures are employed in one of the main rod support member 77 and wall mountable flange, separate fasteners are not required.

Referring to FIG. 11, an intermediate supplemental rod bracket assembly 72 can be supported from each intermediate main rod bracket assembly 70. The intermediate supplemental rod bracket assembly 72 has a right angle bracket 83. Extending transversely and forwardly from the flange is a member 85 having a central axial slot. A rectangular slider 87, also having a central axial slot, is mounted beneath the extending member 85 of the right angle bracket 83 whereby the slider 87 can be telescoped relative to the right angle bracket 83 and locked in place by two screws. Mounted beneath the slider is a downward facing truncated circular holder 89 having an aperture into which a set screw 90 is threaded. The cylindrical curtain rod 68 can be inserted into the holder and held in place by tightening the set screw against the circumference of the cylindrical curtain rod 68. The truncated circular holder 89 can be affixed to the slider by means of one of the set screws 92 that fixes the slider relative to the extending member of the right angle bracket.

The intermediate supplemental rod bracket 72 assembly can be adjusted to accommodate the distance of the main rod from the wall by loosening the set screws to move the main rod support member inwardly and outwardly relative to the wall mountable flange, and thereafter tightening the set screws to hold the main rod support member in place. Where slots are used in both the main rod support member and wall mountable flange, fasteners can be provided to lock the set screws in place. Where threaded apertures are employed in one of the main rod support member and wall mountable flange, separate fasteners are not required.

In applications where variation of the height of the supplemental curtain rod 68 relative to the main curtain rod 1 is not required, a truncated circular holder 89, with set screw 90 can be mounted on the main rod support member 77 as shown in FIG. 11. The relationship of the intermediate and end brackets for supporting a main curtain rod 1 and a supplemental curtain rod 68 can be seen in FIG. 12.

Figure 13:
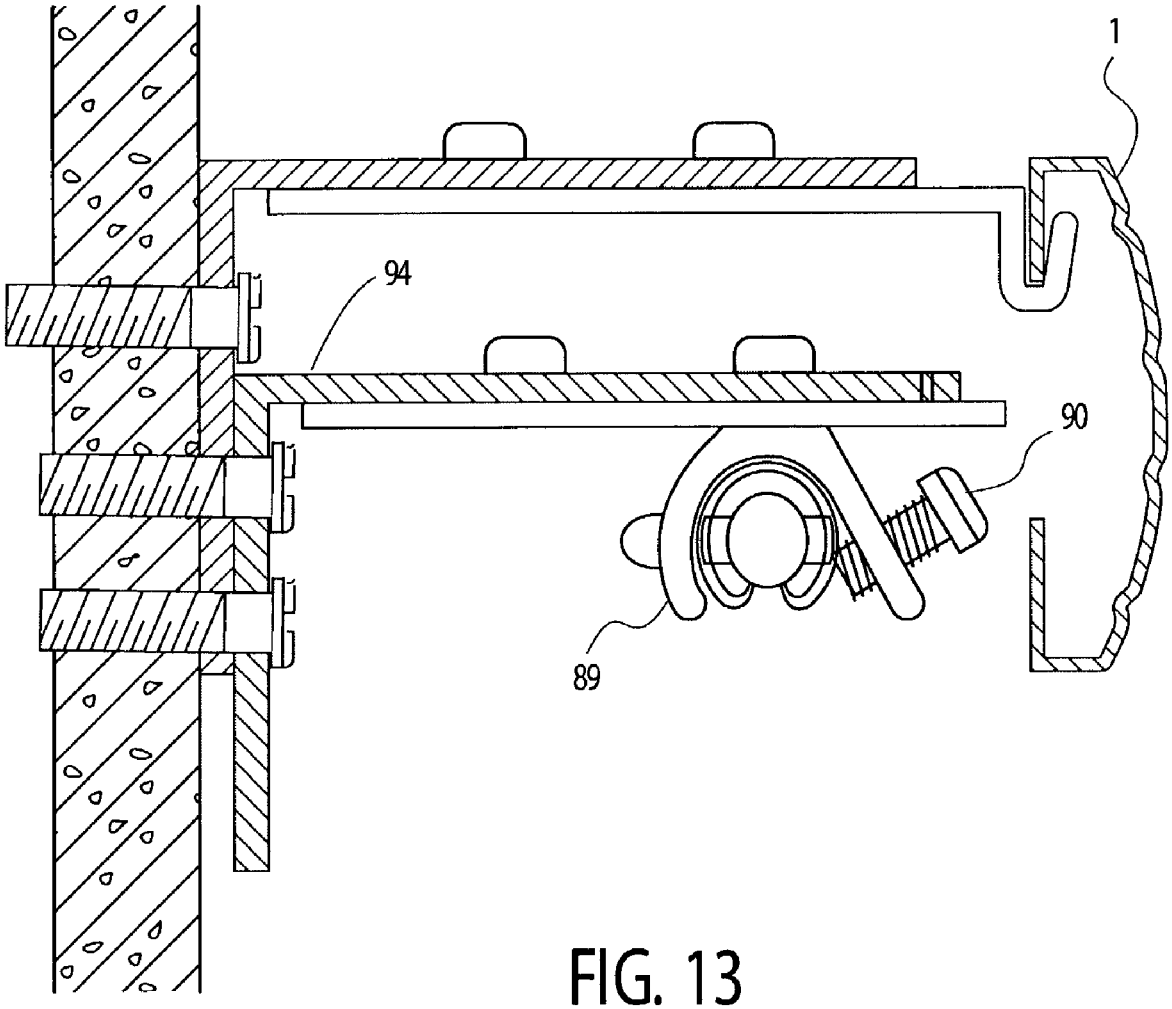
FIG. 13 is a side sectional elevation view of an assembly of a main rod and supplemental curtain rod with a bracket for supporting the rods at different heights intermediate their ends in accordance with the preferred embodiment of the invention.

Instead of a completely cylindrical rod, the supplemental rod can have telescoped segments each with an inwardly turned C-like cross section and a longitudinal slot facing downwardly as seen in FIGS. 11–13.

In applications where variation of the height of the supplemental curtain rod 68 relative to the main curtain rod 1 is desirable, a circular holder 89, with set screw 90 can be mounted on a separate support bracket 94 as shown in FIG. 13. The support bracket 94 preferably has a wall-mounting flange with fingers and notches like the bracket flange 52 illustrated in FIGS. 4 and 8 so that no additional fasteners need penetrate the wall.

Figure 14:
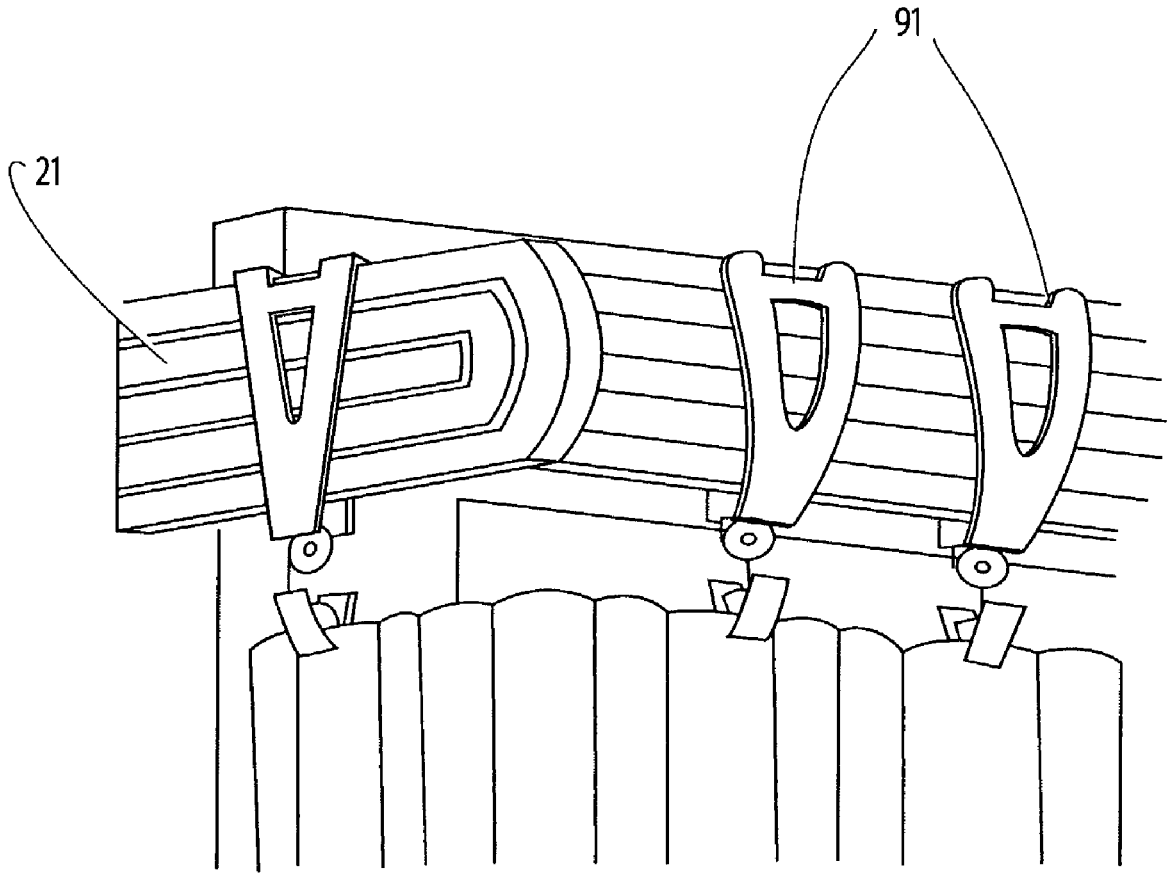
FIG. 14 is a fragmentary perspective view of curtains hung on a curtain rod in accordance with the preferred embodiment of the invention.
Figure 15:
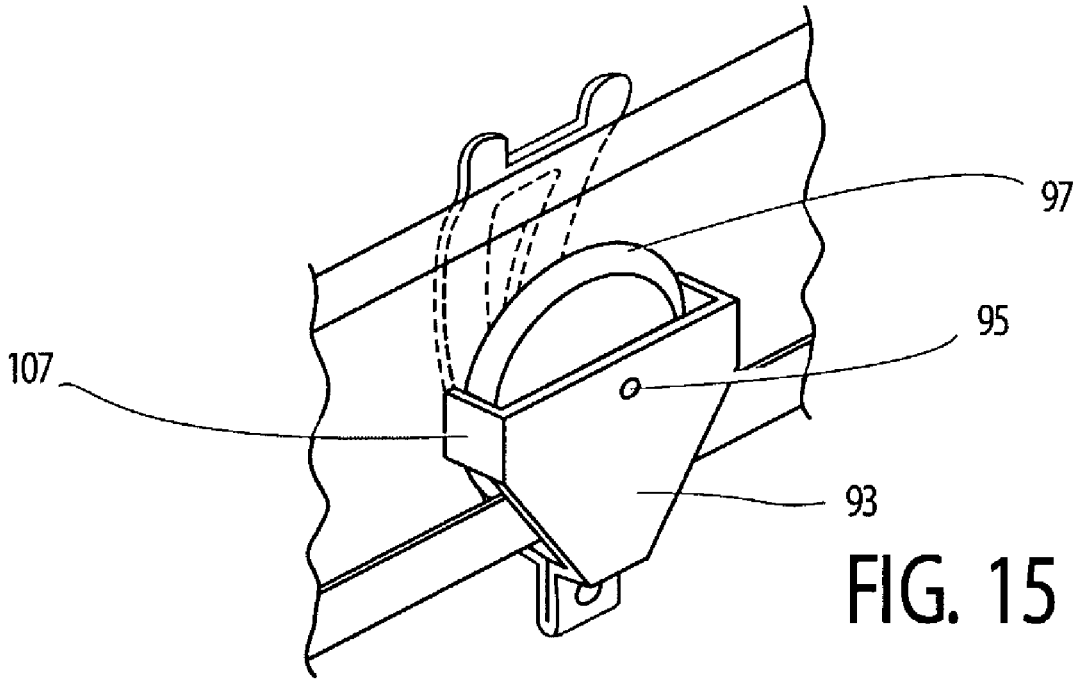
FIG. 15 is a rear perspective view of a curtain hanger mounted on a main curtain rod in accordance with the preferred embodiment of the invention.
Figure 16:
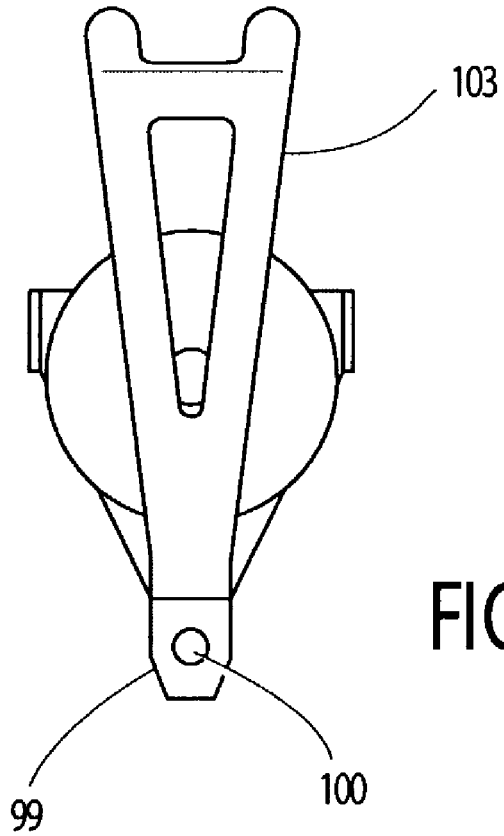
FIG. 16 is a front elevation view of the curtain hanger of FIG. 15.

Referring now to FIG. 14, a plurality of identical curtain hangers 91 ride in the lower channels of the main rod segments. As seen in FIGS. 15 and 16, each hanger 91 is preferably formed from sheet metal and has a generally triangular housing with a downward pointing, planar portion 93 in which one end of a forward extending axle 95 is journaled. Mounted on each axle is a wheel 97 which rides in the lower channels 15 of the main rod segments. Extending downwardly from the planar portion 93 of each hanger, below the bottom edges 8 of the main rod segments, is a tab 99 having an aperture 100 for receiving an upper segment of a conventional S-shaped curtain hook, the lower hook segment being adapted for being passed through the upper border of a curtain as is known in the art.

Extending upwardly from the tab 99, in front of the face of each main rod segment is an ornamental shield 103 curved to generally conform to the contour of the face 7 of each main rod segment, and which rides in front of the face 7 as the wheel 97 of its respective hanger 91 rides in the lower channel 15. The shield has the general form of an inverted "A" in the preferred embodiment of the invention. However, it is to be appreciated that the shield may be of virtually any form considered to be aesthetically pleasing. The shield may be have a finish similar to, or coordinated with, the finish of the main rod segments and corner bracket to enhance the aesthetics of the main rod.

The upper two corners of the triangular planar portions 93 of each hanger 91 are bent rearwardly to form horizontally aligned bumpers 107 occupying respective planes parallel to the axle on which the wheel is mounted and transverse to the direction of travel of the hanger 91 along the rod 1. The distance between bumpers 107 is slightly greater than the diameter of each wheel and shield each wheel from the wheel an adjacent hanger thereby preventing adjacent wheels from overlapping and binding their hangers when one hanger engages another. During engagement of adjacent hangers, which can occur as the curtains are drawn, the parallel surfaces of adjacent hanger bumpers engage and are freely separable without any possibility of binding.

Figure 17:
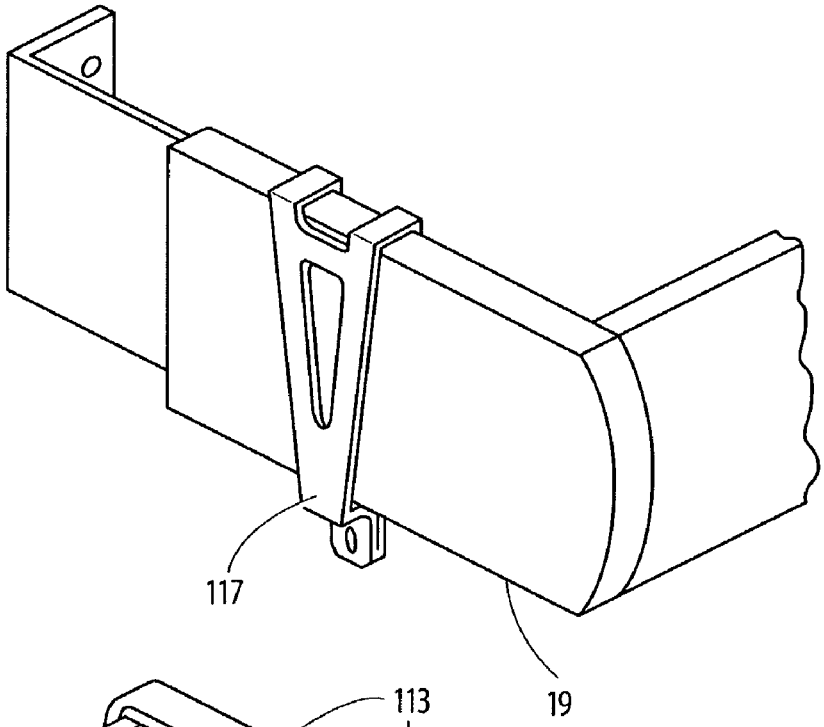
FIG. 17 is a front perspective view showing a hanger for use on the main curtain hanging bracket of the invention.
Figure 18:
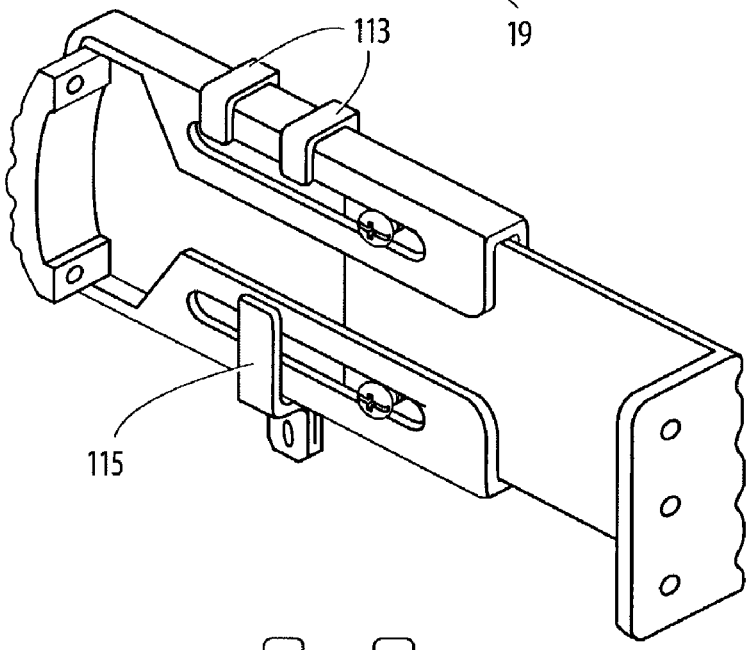
FIG. 18 is a rear perspective view showing a hanger for use on the main curtain hanging bracket of the invention.
Figure 19:
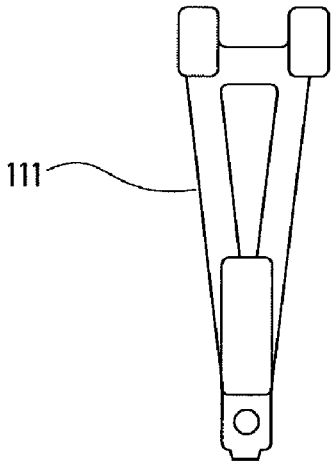
FIG. 19 is a front elevation view of the curtain hanger of FIGS. 17 and 18.

Referring now to FIGS. 17–19, in order to enable the sides of the main set of curtains to be hung beneath the corner bracket assemblies in close proximity to the wall as shown in FIG. 14, auxiliary hangers 111 may be provided with upper claws 113 and a lower claw 115 extending from a shield 117 similar in appearance to the shields 103. The auxiliary hangers 111 can be passed over the plate 20 of the corner bracket 19 as shown in FIGS. 17 and 18. Like the shields 103, each shield 111 has a tab 99 for supporting a curtain hook.

It is to be appreciated that the foregoing is a description of a preferred embodiment of the invention and several variations which may be modified without departing from the spirit of the invention which is limited only by the following claims.

What is claimed is:

1. Apparatus for hanging curtains comprising, a main curtain rod bracket having means for engaging a main curtain rod intended to receive a main set of curtains, and means for attachment to a wall, and a supplementary curtain rod bracket having means for engaging a supplementary curtain rod intended to receive a supplementary set of curtains, and means for mounting said supplementary curtain rod bracket on said main curtain rod bracket comprising a plurality of spaced fingers separated by notches, at least a portion of said means for attachment to the wall being receivable within said notches, whereby said supplementary set of curtains may be hung without need for said supplementary curtain rod bracket to be attached to the wall.

2. Apparatus for hanging curtains comprising, a main curtain rod bracket having means for engaging a main curtain rod intended to receive a main set of curtains, and means for attachment to a wall, said main curtain rod having a downward facing open channel and said main curtain rod bracket having an upward projection for being received in said channel to support said main curtain rod intermediate both ends of said main curtain rod, and a supplementary curtain rod bracket having means for engaging a supplementary curtain rod intended to receive a supplementary set of curtains, and means for mounting said supplementary curtain rod bracket on said main curtain rod bracket, whereby said supplementary set of curtains may be hung without need for said supplementary curtain rod bracket to be attached to the wall.

3. Apparatus for hanging curtains comprising a main curtain rod having an open channel with a longitudinal axis and a plurality of curtain hangers, each of said hangers having a roller disposed in said channel for enabling relative translation of said hanger with respect to said rod, and a pair of substantially planar bumpers disposed on opposite exterior sides of said hanger and extending substantially orthogonally to a first planar surface of said hanger and separated by a distance equal to the maximum width of said hanger measured in a direction parallel to said axis, whereby as one of said hangers approaches another of said hangers adjacent bumpers engage thereby preventing binding of adjacent hangers.

4. Apparatus for hanging curtains according to claim 3 wherein each of said hangers comprises a wall in a pane parallel to the plane of rotation of said wheel, said wall having a generally triangular profile with two of the corners thereof being bent into mutually parallel planes transverse to the plane of said triangle for forming said bumpers.

5. A curtain hanger adapted to be translated along a channel within a curtain rod comprising a wall, an axle having one end mounted on said wall, the axis of said axle being orthogonal to the plane of said wall, a roller rotatably mounted on said axle, two bumpers disposed on diametrically opposite sides of said roller and separated by a distance greater than the diameter of said roller, a shield, said bumpers being connected to said hanger wall and extending toward said shield, said roller being disposed between said shield and said hanger wall, said hanger wall having a generally inverted triangular profile with two upper corners thereof being bent toward said shield into mutually parallel planes transverse to the plane of said triangle for forming said bumpers.

6. A supplementary curtain rod bracket for supporting a supplementary curtain rod in proximity to a horizontal main curtain rod supported by a main curtain rod bracket, said supplementary curtain rod bracket comprising a plurality of vertically spaced fingers separated by notches through which a fastener adapted to extend from said main curtain rod bracket can be passed for mounting said supplementary curtain rod bracket on said main curtain rod bracket, and means for supporting said supplementary curtain rod; wherein said supporting means is adapted to hold said supplementary curtain rod when mounted thereto, in a parallel spaced relationship to said horizontal main curtain rod so that the height of said supplementary curtain rod relative to said main curtain rod can be determined by the notch through which said fastener is passed.

7. A supplementary curtain rod bracket in accordance with claim 6 further comprising a horizontally slidable extension for enabling variation of a horizontal distance between said wall and a supplementary curtain rod.

8. A supplementary curtain rod bracket in accordance with claim 6 further comprising a portion having a slot for receiving a projection at the end of said supplementary curtain rod.

9. A supplementary curtain rod bracket in accordance with claim 6 further comprising an arcuate holder for receiving a portion of the circumference of a supplementary curtain rod and retaining means for securing said supplementary curtain rod within said arcuate holder.

10. A curtain hanger adapted to be translated along a channel within a curtain rod comprising a wall adapted to be disposed in a plane parallel to a longitudinal axis of said channel, an axle having one end mounted on said wall, the axis of said axle being orthogonal to the plane of said wall, a roller rotatably mounted on said axle, and two bumpers disposed on opposite extremities of said hanger, whereby as one of said hangers approaches another of said hangers adjacent bumpers engage thereby preventing binding of adjacent hangers.

* * * * *